US006154421A

United States Patent [19]

Solomon

[11] Patent Number: 6,154,421

[45] Date of Patent: Nov. 28, 2000

[54] CALENDAR-TIMEPIECE COMBINATION

[76] Inventor: Idit Solomon, Kedumim, D.N. Shomron, Israel

[21] Appl. No.: 09/281,015

[22] Filed: Mar. 30, 1999

[51] Int. Cl.[7] ..... G04B 19/24

[52] U.S. Cl. ..... 368/28; 368/37; 368/29

[58] Field of Search ..... 368/28–40

[56] References Cited

U.S. PATENT DOCUMENTS

| | | | |
|---|---|---|---|
| 422,090 | 2/1890 | Miller | 368/28 |
| 2,305,506 | 12/1942 | Woodruff | 368/21 |

FOREIGN PATENT DOCUMENTS

| | | | |
|---|---|---|---|
| 1126099 | 11/1956 | France | 368/28 |
| 400163 | 2/1930 | Germany | 368/28 |

*Primary Examiner*—Bernard Roskoski

*Attorney, Agent, or Firm*—Eitan, Pearl, Latzer & Cohen-Zedek

[57] ABSTRACT

An analog timepiece having a novel means of displaying the current day of the month and indicating the current month of the year. Proximate to each of the hour positions 1 through 12 on the timepiece is a window for displaying the date; the date is displayed in only one of the twelve windows so that the window position proximate to the hour position corresponds to the current month's position within the twelve month calendar year.

15 Claims, 5 Drawing Sheets

CALENDAR-TIMEPIECE COMBINATION

FIELD OF THE INVENTION

This invention relates generally to timepieces that include calendar data, and particularly to analog timepieces that display such calendar data.

BACKGROUND OF THE INVENTION

Analog timepieces that have calendar data displayed thereon are known to have a body containing the mechanical time-keeping structure with a face on the outside having up to twelve ordinal numbers, or indications representing numbers. The date may be displayed thereon in a variety of ways including in a fixed window. The date, once set by the wearer, is automatically updated every twenty-four hours. However, such analog timepieces, as compared to digital timepieces, do not usually display the current month of the year on the face of the timepiece and if they do display the month, it is written in an abbreviated form in a separate fixed window (i.e., "Jan" to represent January). Thus, in order to display the information desired on the face of an analog wrist-watch as presently known in the art, the face would include at least two separate fixed windows containing the current date and an abbreviation of the current month, thereby creating a crowded and busy-looking watch face.

In contrast to an analog timepiece, a digital timepiece, most notably a watch, may display a series of calendar data such as the present time (hour, minute and even second or tenths and hundreds of a second) and the date (in day, month and year format). However, some wristwatch wearers would prefer an "old fashioned" analog wristwatch over a digital wristwatch for a variety of reasons.

This invention provides a new way of displaying the current time, date and month for the wearer of analog timepieces in a pleasing manner. This, and other advantages, features and objects will become more apparent from the following description taken in connection with the illustrative embodiments in the accompanying drawings.

SUMMARY OF THE INVENTION

The present invention is based on the recognition that the number of months in a Gregorian calendar year is equal to the number of hours normally displayed on the face of an analog watch. Up to twelve windows are arranged on the face of an analog wristwatch, each proximate to the ordinal number or indication representing the hour of a half-day. Thus, there may be twelve windows placed on the face of the watch to correspond to twelve months in the year. The number twelve also signifies the number of hours in a half-day.

The date of the month is displayed in a selected window, the window's position chosen to indicate the month of the year. Therefore, in January the window activated is proximate to the hour number 1, in February the window activated is proximate to the hour number 2, and so on through December when the window activated is proximate to the hour number 12.

If there is more than one window on the face of the watch, the remaining inactivated windows may take on the color of the face of the watch, or be illuminated but without a number for the date displayed within. The date displayed in the window would be the current date.

Therefore, it is an object of this invention to provide an analog timepiece having at least twelve hour positions, up to twelve windows each spaced proximate to the twelve hour positions, and a display visible through each of the windows. The date is displayed in only one of the corresponding displays, selected as the one proximate to the appropriate hour positions so as to correspond with the current month.

BRIEF DESCRIPTION OF THE DRAWINGS

A calendar timepiece in accordance with the present invention will be described infra with reference to the accompanying drawings, which are not drawn to scale, of which.

DETAILED DESCRIPTION OF THE PREFERRED EMBODIMENTS

Figure 1:
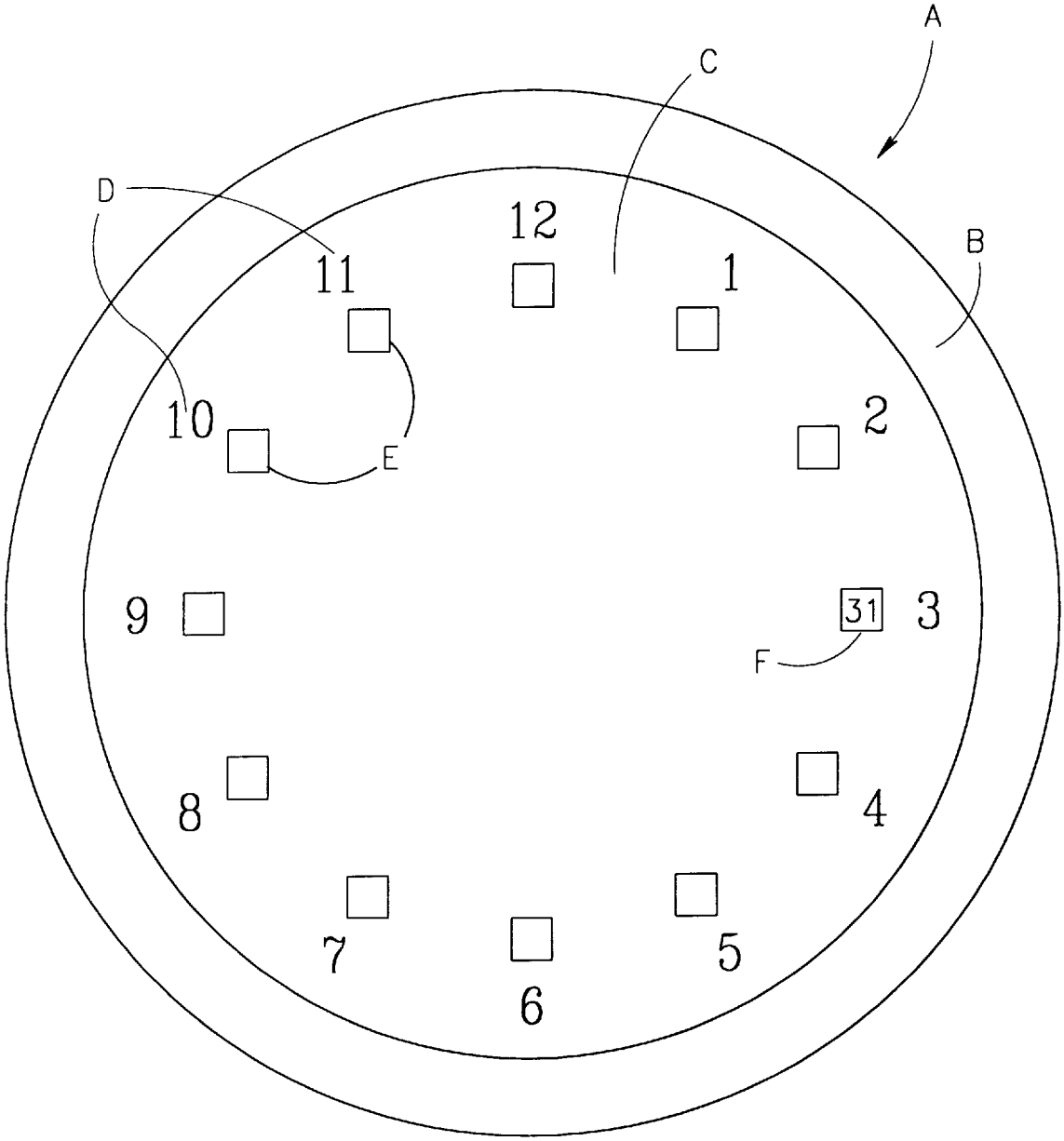
FIG. 1 is a frontal view of a timepiece incorporating the concept of one embodiment of the invention as it would appear on the 31st day of the month of March.

Referring to the drawings wherein like reference letters designate like parts, there is shown is FIG. 1 a timepiece, A, comprised of a body B having a twelve-hour analog watch face, C, with ordinal numerals, D, thereon. Conventional hour, minute and/or second hands (well known and not shown) are provided. The shape of the body B of the timepiece A need not be circular and can any of the popular configurations, for example, square, rectangular, octagonal, oval, geometric, etc. There are provided twelve windows E, in the face C, one proximate to each of the twelve hour ordinal numbers D. Behind each window E, there is an electronic digital display F, mounted on the rear of the clock face C to present the date of the month. Since the digital displays F may be liquid crystals or light emitting diodes or any of the other displays currently in use, the choice depends on the amount of illumination required in the environment in which the watch-calendar is to be viewed. (References to "watch" are generic and should not be construed to preclude embodying the invention in the kinds of clocks and timepieces known as wristwatches, pocket watches, wall clocks or other clocks and watches.)

Figure 2:
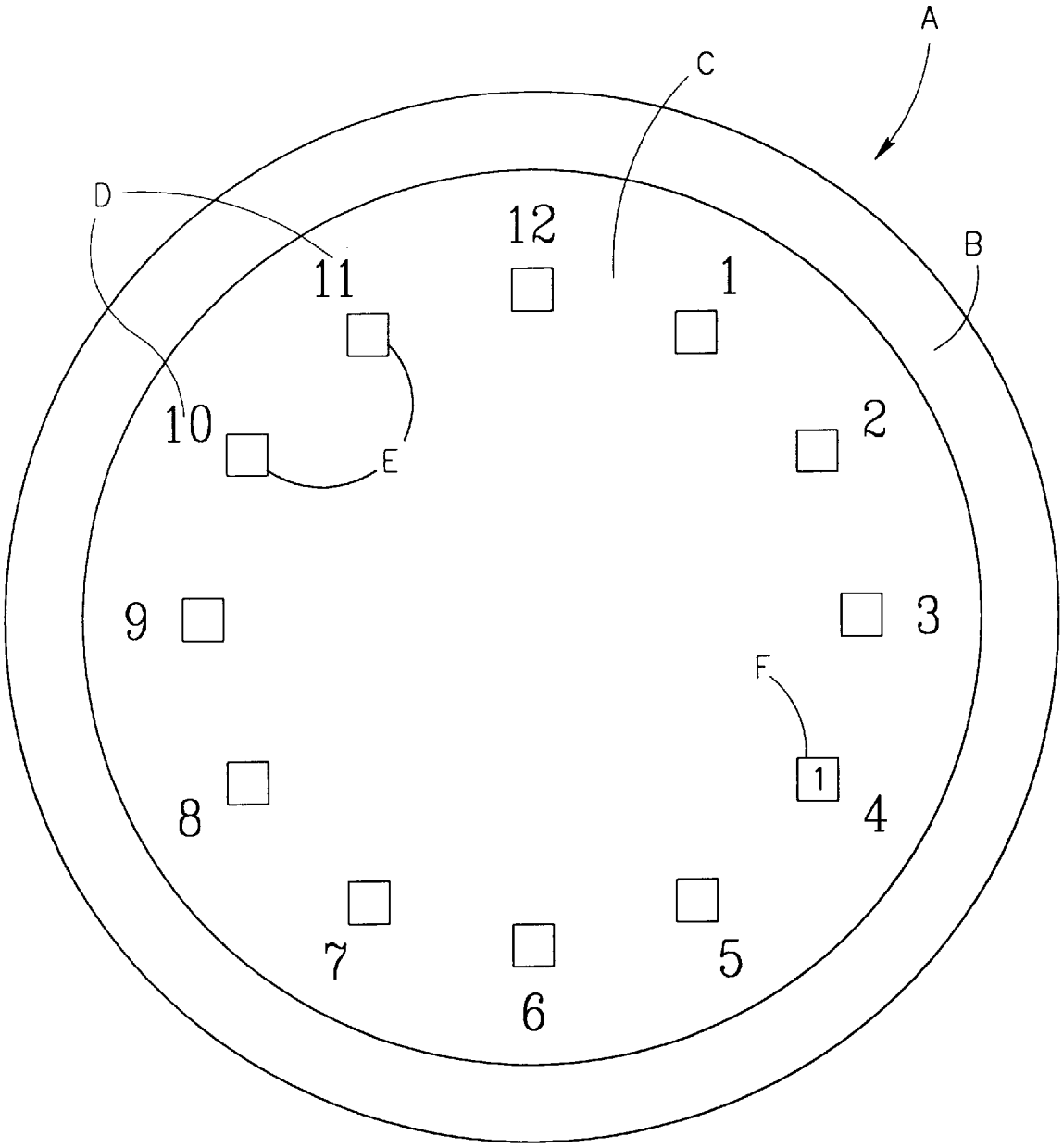
FIG. 2 if a frontal view of FIG. 1 as it would appear on the 1st day of the month of April.

Each of the displays F is activated in the present embodiment by a switch (not shown) that is operated by the circuitry of standard digital timers. Upon detecting the transition to a new month, a digital timer activates the particular display F proximate to the hour ordinal number on the clock face corresponding to the new month (e.g., 1 for January, 2 for February, etc.). For example, FIG. 1 depicts timepiece A as it would appear on March 31. The particular display F illuminates the number 31 proximate to the clock face numeral 3 so as to connote the 31st day of the third month, March. FIG. 2 depicts the timepiece as it would appear on the next day, April 1. It is seen that the date—1—is then displayed on the particular window display proximate to position and ordinal numeral 4, which connotes the fourth month, April. Thus, the wearer can read that the date is April 1st.

If a twenty-four hour timepiece were used, only the hour numbers from 1 through 12 need to have windows equipped with displays F as there are only twelve months in a year. However, for esthetic reasons, windows might be provided adjacent to all of the twenty-four hour numbers to enhance symmetry, although only the twelve windows adjacent to the numbers 1 through 12 would ever display the date.

In an alternative embodiment, hour numerals D might be omitted completely leaving the face C blank. In another embodiment either straight line indications set at the 3, 6, 9 and 12 hour positions placed on the face C may be used in place of ordinal numbers. In both of these embodiment the typical user is still able to tell the time in accordance with the positions of the clock hand as the ordinal numerals corresponding to those positions have been memorized.

In another alternative embodiment where there are twelve windows on the face of the watch, the eleven displays F which do not correspond to the current month and which are not displaying any numeral take on the color of the clock face, while the one display F that does correspond to the current month and which is displaying a date numeral displays it on a background color different from that of the watch face.

Figure 3:
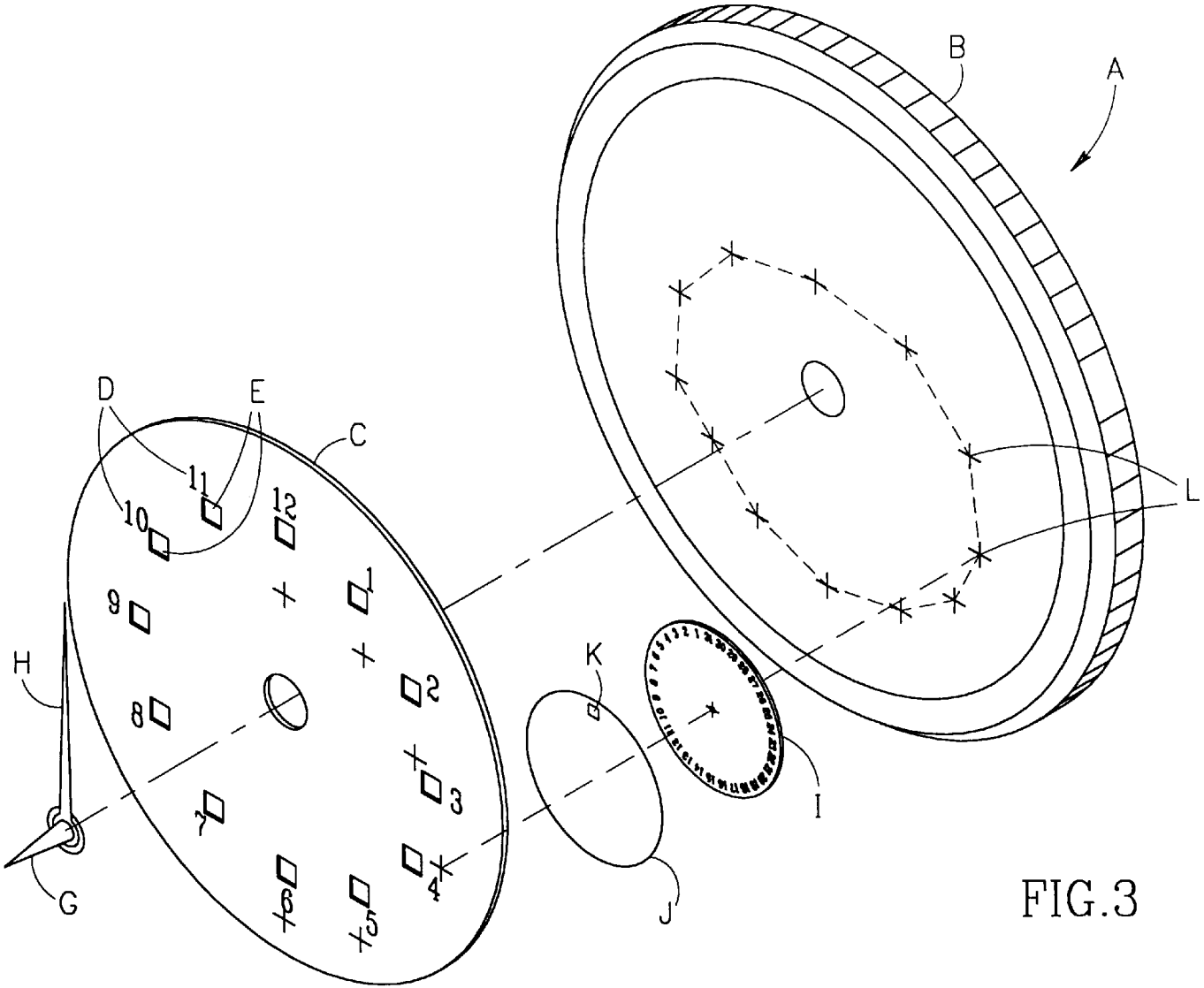
FIG. 3 is an exploded view of another embodiment of the invention.
Figure 5:
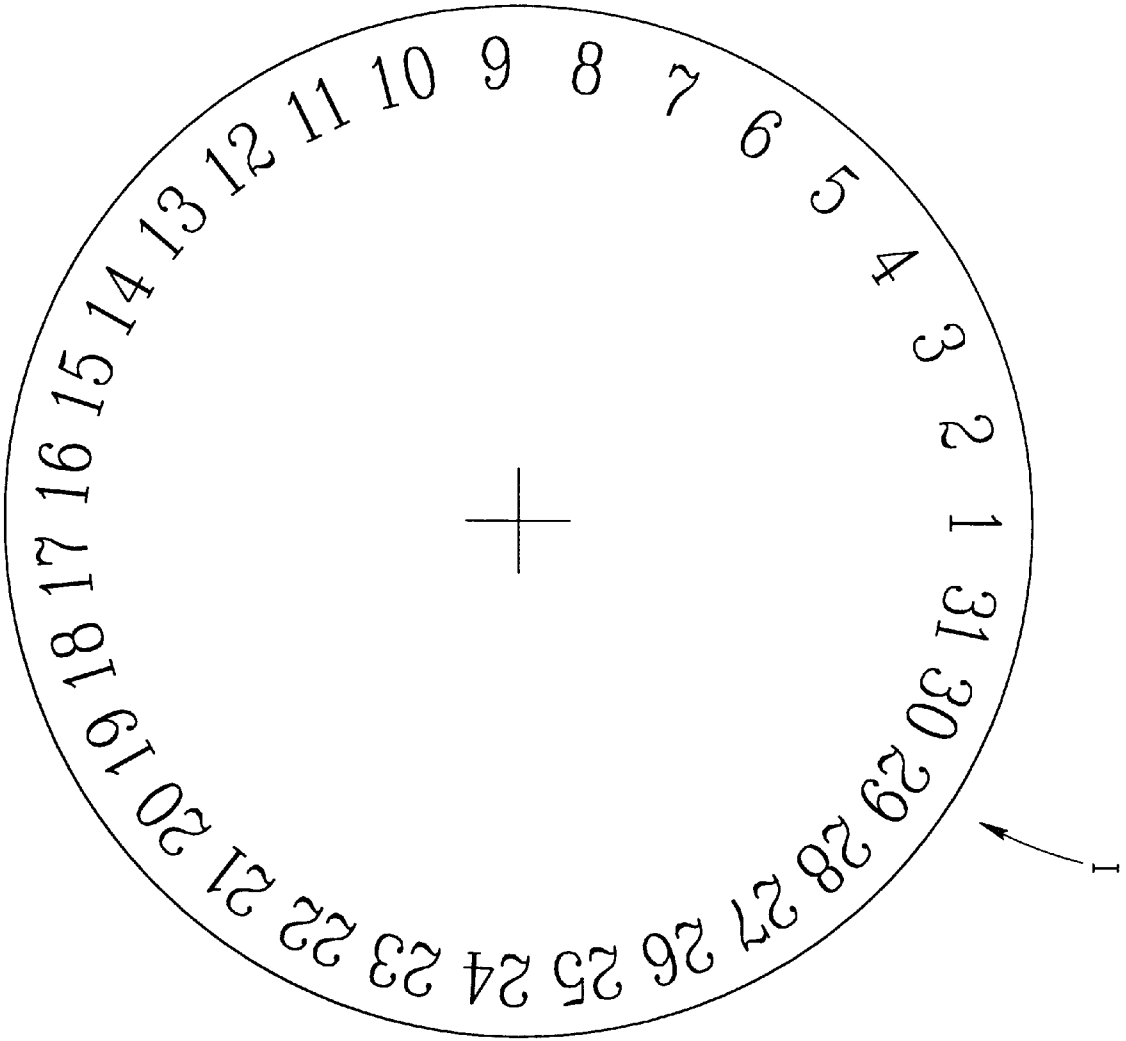
FIG. 5 depicts detail of element I of FIGS. 3 and 4.

FIG. 3 illustrates an alternative embodiment having a mechanical date display instead of an electronic display. This embodiment has timepiece A, comprising body B, face C, numerals D, twelve windows E, hour hand G, and minute hand H, all of which function as they did with the embodiment of FIG. 1. However, the embodiment of FIG. 3 does not have digital displays F, but has mechanical disk I with the numerals 1 through 31 visible around the periphery of its face. (Disk I is shown in detail in FIG. 5.) To display the date and indicate the month in the manner depicted in FIGS. 1 and 2, entire disk I is revolved about the center of the watch face to such position that the numerals on it are visible through the window E corresponding to the current month, and disk I is rotated about its own center such that the current date is displayed through that window E.

FIG. 3 is not to any actual scale. For example, depending on the size of the disk I and the spacing among windows E in an actual construction, extraneous portions of disk I might be visible through some of windows E other than the one corresponding to the current month. Further, shield J, having a window K, may be provided so that the window K may be aligned with the current date on disk I and aligned with the window E corresponding to the current month, permitting display of the current date through the appropriate window E while blocking view of extraneous portions of disk I through other windows E.

Figure 4:
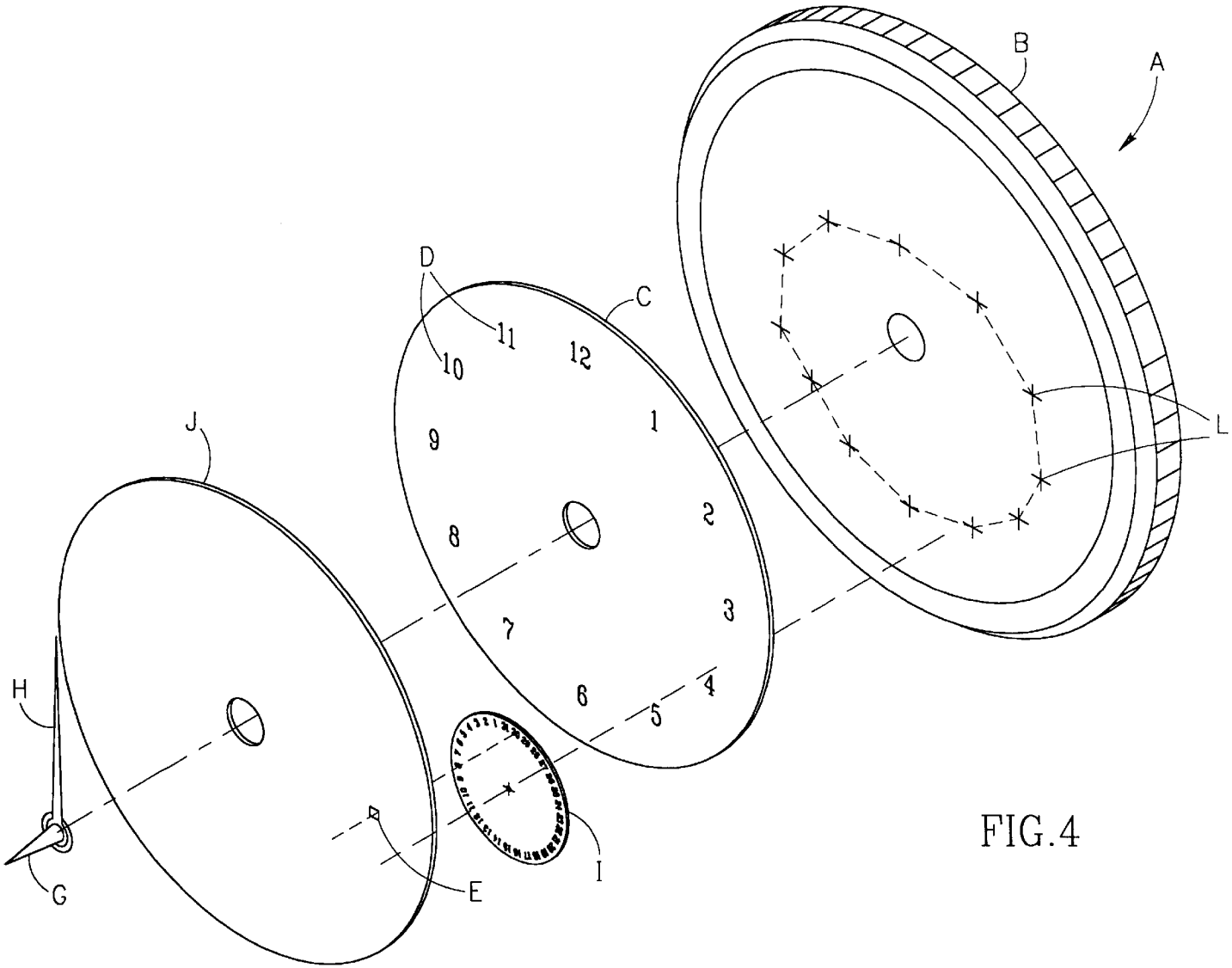
FIG. 4 is an exploded view of another embodiment of the invention.

FIG. 4 illustrates an alternative embodiment of FIG. 3 wherein timepiece A has only one window E. The timepiece A is comprised of body B, face C, numerals D, hour hand G, and minute hand H. The size and order in which mechanical disk I and shield J are placed in relation to face C are different than in FIG. 3. In FIG. 4, the shield J containing one window E is of a slightly smaller size than face C so that shield J may be set on top of face C while still allowing numerals D to be displayed. Disk I is then set between shield J and face C. Disk I revolves around its own center and also revolves on a separate link around the center of the body B so that the date numeral on disk I may be displayed in window E to correspond with the current date.

While the design of a mechanism for rotating and revolving disk I (and shield J, if provided) in the manner described is probably more complex than the electronic display described above, it is well within the ability of one skilled in the clockwork art to design such a mechanism.

OPERATION

Operation of the embodiment of FIG. 1 in a digital watch merely involves the application of power to standard circuits. Thus, the watch/clock hands will operate as on any of the usual mechanical, electrical or quartz electronic timepieces. However, windows E, adjacent to each of the numerals D, behind which are standard electronic display units F which provide the date of the month, represent a departure from that which has previously been produced. The appropriate display is energized at the time of occurrence of a change of the month so that the position of the display next to a particular hour ordinal number corresponds to the number of the month. Usage of the signal for the change of month allows for the activation or switching to the appropriate display. The standard circuitry for display of the month and day for wrist watches can be used with a minimum of modification, well within the capability of one skilled in the art to produce the desired result. The corresponding operation of a mechanical watch as depicted in FIG. 1 is also well within the capability of one skilled in the art to produce the desired result.

The setting of the time for all embodiments depends upon the timepiece system used and is not a major concern. Space allocation is easily solved within the scope of ordinary skill in the art.

Although the invention has been illustrated in the accompanying drawings and described in the foregoing specification in terms of preferred embodiments thereof, the invention is not limited to these embodiments. It will be apparent to those skilled in this art that certain changes, modifications and substitutions can be made without departing from the true spirit and scope of the appended claims.

I claim:

1. A timepiece for displaying calendar data comprising:

a body having a face with at least one window positioned proximate to a space symmetrically associated with hours 1 through 12, and at least two hands connected to the face; and a position selector for selecting the position of one window so as to place the window positioned corresponding to a particular month to enable the window to display an indication of a day of the month whereby a timepiece is provided in which the hour, the month and the day are displayed.

2. The timepiece recited in claim 1, wherein the number of windows is one.

3. The timepiece recited in claim 1, wherein the number of windows is twelve.

4. The timepiece recited in claim 1, wherein the window to display an indication of the month in the window is an electronically operated display.

5. The timepiece recited in claim 4, wherein the electronic display is a liquid crystal (LCD) display.

6. The timepiece recited in claim 4, wherein the electronic display operation is a light-emitting diode (LED) display.

7. The timepiece recited in claim 1, wherein the display is a mechanical graphic display.

8. The timepiece recited in claim 7, wherein:

the mechanical display includes a disk having numerals 1 through 31 arranged proximate to its periphery;

the numerals are of a size relative to the window so that only one of the numerals is visible at a time through the selected window;

the timepiece is adapted to position the disk so that a portion proximate to the disk's periphery and bearing the numerals is visible through the selected window; and the timepiece is further adapted to rotate the disk so that one of the numerals corresponding to the current date is visible through the selected window.

9. The timepiece recited in claim 3, wherein;

the face is of a first color;

the display displays the current date on a background of a second color different from the first color; and the first color appears in all of the windows other than the selected window.

10. An analog watch comprising:

a body having a face having at least two hands and at least one window being positioned proximate to a space symmetrically associated with hours 1 through 12; and a position selector for selecting the position of one of the windows so as to place the window positioned corresponding to a particular month to enable the window to display an indication of a day of the month whereby a timepiece is provided in which the hour, the month and the date are displayed.

11. The analog watch recited in claim 10, wherein the position selector comprises;

a disk removable and rotatable and mounted to the body;

the disk having numerals 1 through 31 arranged proximate to its periphery;

the numerals being of such size relative to the selected window that only one numeral is visible at a time through the one certain window;

the face, body and disk being arranged so that the disk is capable of being manipulated when the face is removed from the body; and the body being adapted to retain the disk at any of twelve locations on the body, each location arranged so that a portion proximate to the disk's periphery and bearing the numerals will be visible through a window.

12. The analog watch recited in claim 10, wherein the position selector comprises;

a shield mounted on the face of a size smaller than the face;

a disk removable and rotatable and mounted to the body;

the disk having numerals 1 through 31 arranged proximate to its periphery;

the numerals being of such size relative to the selected window that only one numeral is visible at a time through the one certain window;

the face, shield, disk and body being arranged so that the disk is capable of being manipulated when the shield is removed from the face; and the body being adapted to retain the disk at any of twelve locations on the body, each location arranged so that a portion proximate to the disk's periphery and bearing the numerals will be visible through the window.

13. The analog watch recited in claim 10, wherein the watch hands are susceptible of being positioned manually.

14. The analog watch recited in claim 12, further comprising a clock movement coupled to the watch hands for dynamically positioning the hands so as to indicate current time of day.

15. The timepiece recited in claim 1, wherein;

the face is of a first color;

the window displays the current date on a background of a second color different from the first color; and the first color appears in all of the windows other than the one certain window.

* * * * *